US006736359B2

(12) United States Patent
Murray

(10) Patent No.: US 6,736,359 B2
(45) Date of Patent: May 18, 2004

(54) ANCHORING DEVICE FOR USE IN ROCK CREVICES AND THE LIKE DURING ROCK CLIMBING ACTIVITIES

(76) Inventor: Seth Murray, 85 Benthaven Pl., Boulder, CO (US) 80305

( * ) Notice: Subject to any disclaimer, the term of this patent is extended or adjusted under 35 U.S.C. 154(b) by 0 days.

(21) Appl. No.: 10/186,802

(22) Filed: Jul. 1, 2002

(65) Prior Publication Data

US 2003/0006351 A1 Jan. 9, 2003

Related U.S. Application Data

(60) Provisional application No. 60/303,600, filed on Jul. 5, 2001.

(51) Int. Cl.[7] ..... A47F 5/08

(52) U.S. Cl. ..... 248/231.9; 248/925; 482/37

(58) Field of Search ..... 248/231.9, 925, 248/694; 482/37; 81/486, 488

(56) References Cited

U.S. PATENT DOCUMENTS

| | | | | |
|---|---|---|---|---|
| 4,184,657 | A | | 1/1980 | Jardine |
| 4,513,641 | A | * | 4/1985 | Murray et al. ..... 81/486 |
| 4,565,342 | A | | 1/1986 | Grow |
| 4,575,032 | A | | 3/1986 | Taylor |
| 4,586,686 | A | | 5/1986 | Cason |
| 4,643,377 | A | | 2/1987 | Christianson |
| 4,645,149 | A | | 2/1987 | Lowe |
| 4,712,754 | A | | 12/1987 | Brodie |
| 4,781,346 | A | | 11/1988 | Banner |
| 4,832,289 | A | | 5/1989 | Waggoner |
| RE33,104 | E | | 10/1989 | Taylor |
| 4,923,160 | A | | 5/1990 | Waggoner |
| 5,617,767 | A | * | 4/1997 | Nikoden ..... 81/488 |
| 5,860,629 | A | | 1/1999 | Reed |
| 6,042,069 | A | | 3/2000 | Christianson |
| 6,375,139 | B1 | | 4/2002 | Murray et al. |
| 6,474,441 | B1 | * | 11/2002 | Bertolino ..... 182/3 |
| 2002/0162927 | A1 | * | 11/2002 | Brown ..... 248/231.9 |
| 2003/0057337 | A1 | * | 3/2003 | Brown ..... 248/231.9 |

FOREIGN PATENT DOCUMENTS

| | | | |
|---|---|---|---|
| GB | 2158540 A | * | 11/1985 |
| WO | WO 97/10877 | | 3/1997 |

* cited by examiner

*Primary Examiner*—Anita King
*Assistant Examiner*—Naschica S. Morrison
(74) *Attorney, Agent, or Firm*—Emery L. Tracy

(57) ABSTRACT

An anchoring device for use in a rock crevice is provided. The anchoring device is movable from a non-activated position to an activated position. The anchoring device comprises a first axle member and a first cam rotatable about the first axle member with the first cam having a first side surface, a first bottom surface, and a first contact surface, the first contact surface contactable with the first rock wall. A second axle member is provided in a spaced in a parallel configuration from the first axle member with a second cam rotatable about the second axle member. The second cam has a second side surface, a second bottom surface, and a second contact surface, the second contact surface contactable with the second rock wall, wherein in a non-activated position, the first axle member is closer to the first rock wall than the second axle member, the second axle member is closer to the second rock wall than the first axle member, and the first bottom surface of the first cam is free from overlap with the second bottom surface of the second cam.

8 Claims, 3 Drawing Sheets

ANCHORING DEVICE FOR USE IN ROCK CREVICES AND THE LIKE DURING ROCK CLIMBING ACTIVITIES

The present application is a continuation of pending provisional patent application Ser. No. 60/303,600, filed on Jul. 5, 2001, entitled "Protection Device for Use in Rock Crevices and the Like During Rock Climbing Activities".

BACKGROUND OF THE INVENTION

1. Field of the Invention

This invention relates generally to an anchoring device for use in rock crevices and the like during rock climbing activities and, more particularly, it relates to an anchoring device for use in rock crevices and the like which utilizes directly opposed cams supported on dual parallel axles.

2. Description of the Prior Art

When climbers move over difficult or dangerous terrain, it is highly advisable and common practice to utilize a rope to secure the climbers together and to anchor the rope in slidable manner to the mountain or rock face being climbed. Furthermore, in the interests of safety, it is prudent to obtain a firm anchor to which the rope can be suitably secured.

In the past, numerous devices have been devised to assist climbers in securing ropes to cracks or crevices in rock walls for the purpose of climbing safely. Such anchors can be natural, i.e. rock spikes, flakes, chockstones jammed in cracks, natural rock threads, and the like. With such anchors, a separate loop of rope or webbing is attached to the natural anchor and to which the climbing rope is slidably secured.

As an alternative to natural anchors, artificial anchors can be utilized. Thus, artificial chockstones or nuts are known of a variety of shapes and sizes and which are inserted into cracks or holes in the face being climbed. Pitons, also known, are metal spikes of various shapes and sizes, which can be hammered into cracks or crevices in the rock face. Yet again, it is known to provide bolts, a modified form of piton and which are designed to be hammered into drilled holes in solid rock.

So far as natural anchors are concerned, these have no inherent disadvantage so long as the rock of the face being climbed is firm and not smooth. However, at the start of a climb it is often apparent that there are an insufficient number of natural anchors existing over the whole face. Artificial chockstones provide an efficient anchor especially when placed in an uneven crack, but placing the artificial chockstone in place tends to be somewhat difficult and/or time consuming, and some placements can be dislodged by movement of the climbing rope. When all that is available, where an anchor is needed, is a smooth-side, parallel-sided crack, placement of the chockstones is difficult both to make and to ensure it is secured.

Both pitons and bolts again provide extremely efficient anchors, but with pitons being made of metal they can be heavy and difficult to place. Also, since the removal of pitons can be extremely difficult and as they tend to scar the rock surface, many climbers are unwilling to use them. Similarly, bolts take an appreciable length of time to place and cause a permanent disfiguration of the rock face. Due to these problems, there is an unwillingness among climbers to employ bolts, except as a last resort.

More recently, spring loaded camming devices are used incorporating multiple pivoting cams, which are spring-biased toward an open position to allow placement of these devices securely into cracks and rock crevices of varying size. To position the camming devices, the climber simply pulls a trigger closing the cams until the cams fit within the rock crack or crevice. The climber then releases the trigger and the spring or springs expand forcing the cams against the rock surface. An induced static friction force between the camming device and the rock face counteracts the applied load. Because such devices can be subject to substantial loads in holding a falling climber, it is desirable to construct such anchors in a manner which provides the greatest possible structural integrity of the device.

Spring loaded camming devices revolutionized climbing by allowing climbers to protect parallel-sided cracks in a variety of sizes. Conventional spring loaded camming devices utilizing one or two axles are heavier than similar size chockstones. Single axle spring-loaded camming devices are lighter in weight than double axle spring loaded camming devices. Lightweight spring loaded camming devices are important because a climber can carry more protection devices for a given weight thereby making safer climbing. Expansion range is the maximum minus the minimum crevice size a spring-loaded camming device will tolerate. Double axle spring loaded camming devices have more expansion range than single axle spring-loaded camming devices. Expansion range is important because a spring loaded cam device with a lot of expansion range is more likely to fit into a given size crevice.

Accordingly, there exists a need for an anchoring device for use in rock crevices and the like which sufficiently supports a climber during rock climbing activities. Additionally, a need exists for an anchoring device for use in rock crevices and the like during rock climbing activities which utilizes cams supported on dual parallel axles which would allow the configuration to be lightweight and have a large expansion range.

SUMMARY

The present invention is an anchoring device for use in a rock crevice. The anchoring device is movable from a non-activated position to an activated position within the rock crevice with the rock crevice being defined by a first rock wall and an opposing second rock wall. The anchoring device comprises a first axle member and a first cam rotatable about the first axle member with the first cam having a first side surface, a first bottom surface, and a first contact surface. The first contact surface is contactable with the first rock wall. A second axle member is provided and spaced in a parallel configuration from the first axle member with a second cam rotatable about the second axle member. The second cam has a second side surface, a second bottom surface, and a second contact surface with the second contact surface contactable with the second rock wall wherein the first axle member is closer to the first rock wall than the second axle member and the second axle member is closer to the second rock wall than the first axle member.

In addition, the present invention includes an anchoring device for use in a rock crevice. The anchoring device is movable from a non-activated position to an activated position within the rock crevice with the rock crevice being defined by a first rock wall and an opposing second rock wall. The anchoring device comprises a first axle member and a first cam rotatable about the first axle member with the first cam having a first side surface, a first bottom surface, and a first contact surface. The first contact surface is contactable with the first rock wall. A second axle member is positioned and spaced in a parallel configuration from the first axle member with a second cam rotatable about the second axle member. The second cam has a second side surface, a second bottom surface, and a second contact surface with the second contact surface contactable with the second rock wall wherein in a non-activated position, the first bottom surface of the first cam is free from overlap with the second bottom surface of the second cam.

The present invention further includes a method for securing a climber to a rock face. The method comprises providing a first axle member, positioning a first cam in a first longitudinal rotatable position about the first axle member with the first cam having a first side surface, a first bottom surface, and a first contact surface and the first contact surface contactable with the first rock wall, providing a second axle member spaced in a parallel configuration from the first axle member, and positioning a second cam in a second longitudinal rotatable about the second axle member with the second cam having a second side surface, a second bottom surface, and a second contact surface and the second contact surface contactable with the second rock wall wherein in a non-activated position, the first axle member is closer to the first rock wall than the second axle member and the second axle member is closer to the second rock wall than the first axle member and the first bottom surface of the first cam is free from overlap with the second bottom surface of the second cam.

DETAILED DESCRIPTION OF THE PREFERRED EMBODIMENTS

Figure 1:
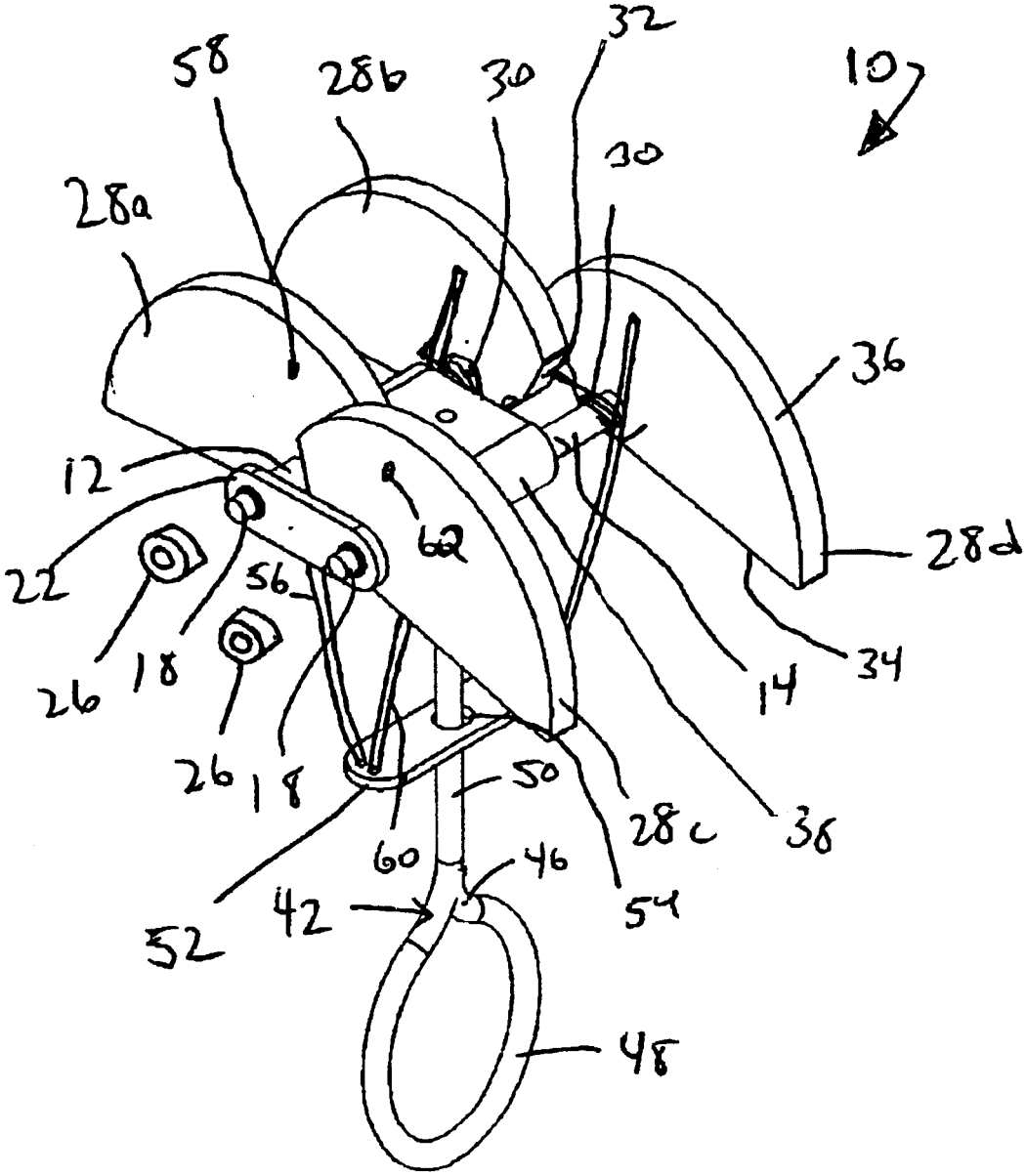
FIG. 1 is a perspective view illustrating an anchoring device for use in rock crevices and the like during rock climbing activities, constructed in accordance with the present invention.
Figure 2:
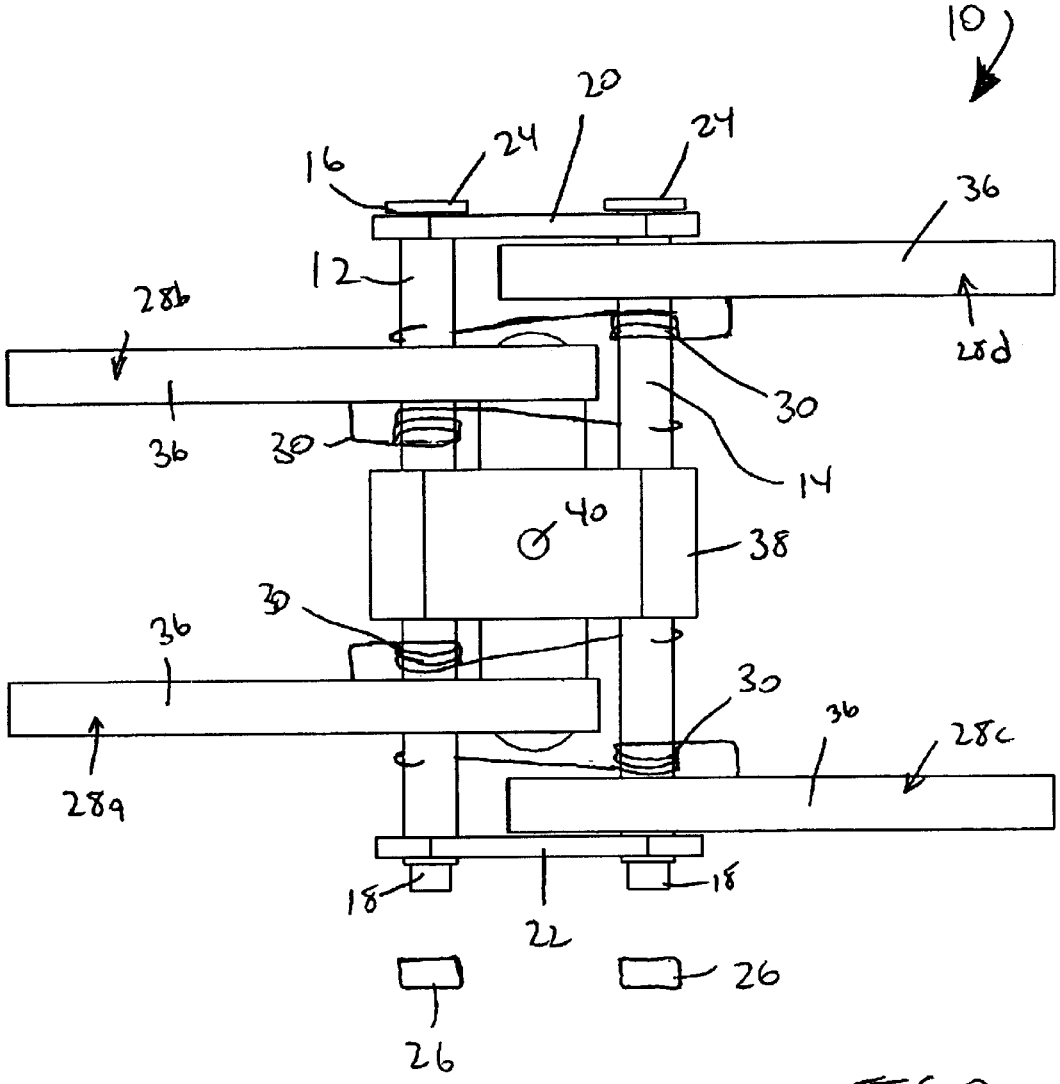
FIG. 2 is a top view illustrating the anchoring device for use in rock crevices and the like during rock climbing activities of FIG. 1, constructed in accordance with the present invention.
Figure 3:
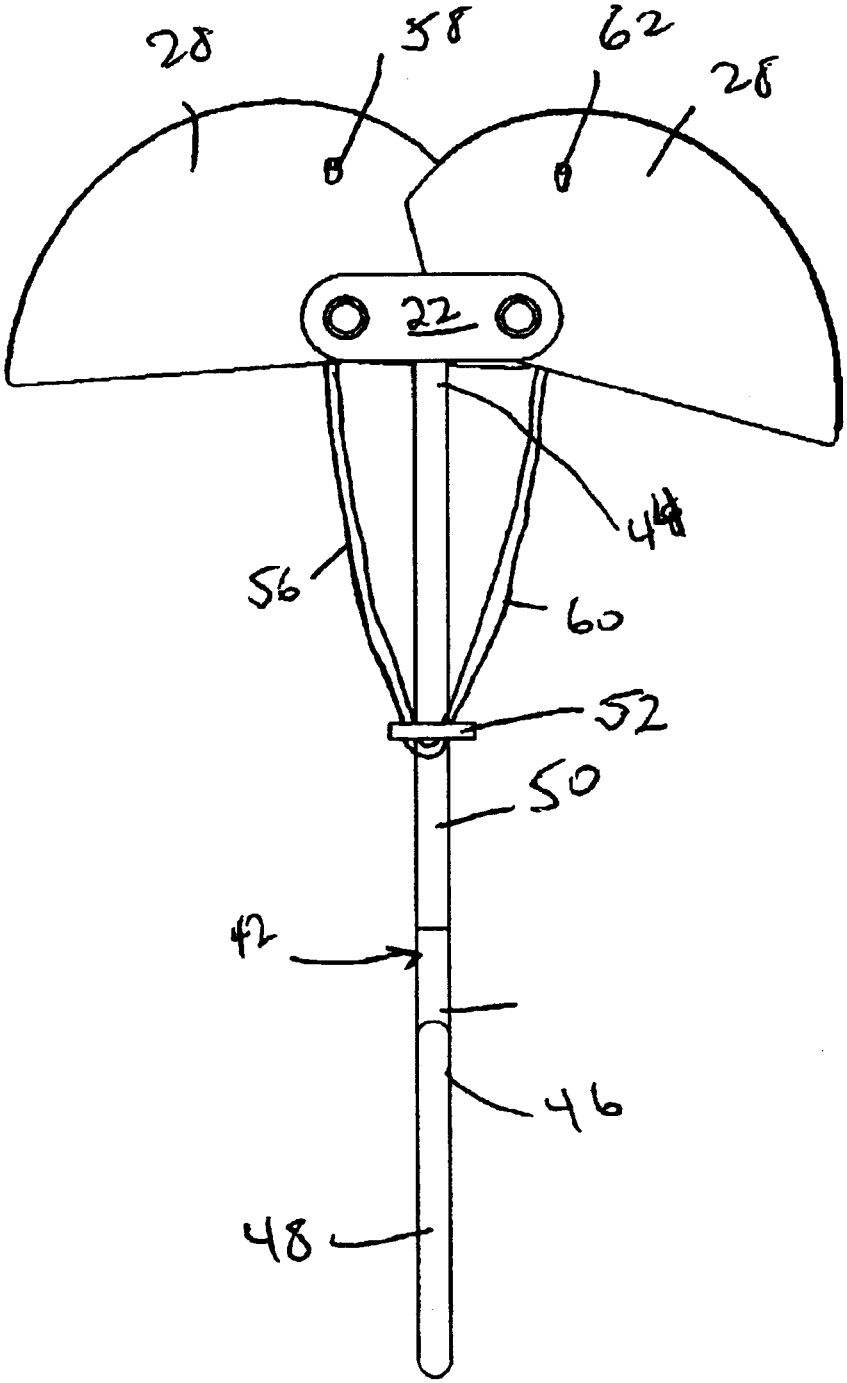
FIG. 3 is an elevational side view illustrating the anchoring device for use in rock crevices and the like during rock climbing activities of FIG. 1, constructed in accordance with the present invention.

As illustrated in FIGS. 1, 2, and 3, the present invention is an anchoring device, indicated generally at 10, for use in rock crevices (not shown) and the like for supporting a climber (not shown) during rock climbing activities. In the present application, each element of the anchoring device 10 will be described first.

The anchoring device 10 of the present invention includes a first axle 12 and a second axle 14 substantially parallel to the first axle 12. The first axle 12 and the second axle 14 each have a first end 16 and a second end 18. A first spacing plate 20 and a second spacing plate 22 are secured to the first ends 16 and the second ends 18, respectively, of the first axle 12 and the second axle 14 for spacing the first axle 12 from the second axle 14. The first end 16 has a flange 24 to maintain the first spacing plate 20 about the first axle 12 and the second axle 14. The second end 18 is preferably threaded for receiving a nut 26 or the like. The flange first end 16 and the nut 26 releasably secured to the second end 18 of the first axle 12 and the second axle end 14, respectively, maintains the first axle 12 and the second axle 14 in a parallel-spaced configuration.

The first axle 12 and the second axle 14 are preferably constructed from a metal material capable of supporting loads greater than approximately two thousand (2000 lbs.) pounds although using other materials to construct the first axle 12 and the second axle 14 are within the scope of the present invention. As discussed, the first axle 12 and the second axle 14 are preferably arranged in a parallel configuration relative to each other and have lengths of between approximately 0.5 inches and approximately 2.0 inches depending on the number of cam members 28 that are present, as will be discussed in further detail immediately below.

The anchoring device 10 of the present invention further includes at least two cam members 28. The first axle 12 and the second axle 14 rotatably support the cam members 28, as illustrated. It should be noted that while figures of the present application illustrate four cam members 28*a*, 28*b*, 28*c*, 28*d*, it is within the scope of the present invention to include less than four cam members 28, i.e., two cam members, or more than four cam members 28, i.e., six cam members, eight cam members, etc. A torsion spring 30 is mounted about the first axle 12 and the second axle 14 and is secured to the cam members 28 to bias opposite cam members 28*a*, 28*b* in a general direction toward each other and to bias opposite cam members 28*c*, 28*d* in a general direction toward each other.

Preferably, each cam member 28 is identical in size and shape to each other cam member 28. In addition, the cam members 28 are preferably constructed from an aluminum material providing high strength, durability, corrosion resistance, and ease of manufacture. Of course, other materials for constructing the cam members 28 are within the scope of the present invention.

Each cam member 28 of the anchoring device 10 has three sides, e.g., a side surface 32, a bottom surface 34 intersecting the side surface 32, and a curved rock contact surface 36 positioned between and intersecting the side surface 32 and the bottom surface 34. Preferably, the curved rock contact surface 36 has a logarithmic spiral configuration. The logarithmic spiral configuration of the curved rock contact surface 36 allows the angle between the line of force and the rock face to remain the same regardless of which portion of the curved rock contact or supporting surface 36 is contacting the rock. Therefore, it follows that a force diagram for the anchoring device 10 will always yield the same results regardless of which portion of the curved rock contact surface 36 is contacting the rock.

In the four or more cam member 28 configuration, the anchoring device 10 includes at least one shaft-receiving center spacer 38. The shaft-receiving center spacer 38 is positioned between the first axle 12 and the second axle 14 for further maintaining the spacing of the first axle 12 and the second axle 14. The first spacing plate 20, the second spacing plate 22, and the center spacer 38 further secures the first axle 12 and the second axle 14 together.

The center spacer 38 of the anchoring device 10 includes a cable-receiving aperture 40 formed in the center spacer 38 for receiving a cable 42. The diameter of the cable-receiving aperture 40 is sized and shaped for receiving and securing the cable 42 therein.

The anchoring device 10 of the present invention additionally includes the cable 42 having a first cable end 44 and a second cable end 46. The first cable end 44 of the cable 42 extends into the cable-receiving aperture 40 of the center spacer 38 and secured therein. The second end 46 of the cable 42 is looped around and swaged to itself to create a loop 48. The loop 48 allows the climber to easily attach a carabiner (not shown) or the like to the anchoring device 10.

Preferably, the cable 42 is a type 304, stainless steel cable with a ⅛-inch diameter to support approximately two thousand (2,000 lbs.) pounds. Other types of cables for use with the anchoring device 10 of the present invention are within the scope of the present invention. Furthermore, a sheath 50 can be positioned about the cable 42 for protecting the cable 42 from wear and damage during climbing activities.

The anchoring device 10 further still includes a trigger device 52 for activating the anchoring device 10 during climbing activities. A cable-receiving aperture 54 is formed in the substantial center of the trigger device 52 for receiving the cable 42 and the sheath 50 and to slidably position the trigger device 52 along the cable 42. The trigger device 52 preferably has a substantially obround shape and is preferably constructed from an aluminum material, although other configurations and materials are within the scope of the present invention.

A first wire 56 extends from the trigger device 52 and connects to a first wire-receiving aperture 58 in the cam member 28*a*. A second wire 60 extends from the trigger device and connects to a second wire-receiving aperture 62 of the cam member 28*b*. For each additional cam member 28, an additional wire extends from the trigger device 52 to the respective cam member 28. Preferably, each wire, including the first wire 56 and the second wire 60, is constructed from a stainless steel material, although other types of materials are within the scope of the present invention.

The operation of the anchor device 10 of the present invention will now be described. A person skilled in the art will understand that the anchor device 10 can be operated in numerous manners and that the description set forth below is merely one manner of operation.

As a climber climbs a rock face, the climber desires to position the anchoring device 10 into a rock crevice or crack formed in a rock face. First, the climber activates the cam members 28 by urging the trigger device 52 in a direction generally away from the cam members 28. The action of the trigger device 52 overcomes the bias of the torsion spring 30 and causes the bottom surface 34 of the cam members 28 to move toward each other. The climber then releases the trigger device 52 causing the torsion spring 30 to bias the supporting contact surface 36 of the cam members 28 against opposed rock surfaces within the rock crevice or crack.

When a load is applied to the anchoring device 10 of the present invention, the reaction forces on cam members 28 urge the cam members 28 in a direction toward each other. The first and second axles 12 and 14 provide a reaction force directly opposite the reaction forces from the cam members 28, such that the axles 12 and 14 are free from any induced moment.

The anchoring device 10 of the present invention offers numerous advantages over conventional rock climbing devices. The anchoring device 10 is easily manufactured with identical cam members 28. The anchoring device 10 is significantly lighter in weight than conventional devices with the same or more expansion range. The anchoring device 10 can withstand the same applied force as conventional devices with the addition of the flexible cable 42 that allows the anchoring device 10 to bend over the rock, when necessary.

The foregoing exemplary descriptions and the illustrative preferred embodiments of the present invention have been explained in the drawings and described in detail, with varying modifications and alternative embodiments being taught. While the invention has been shown, described and illustrated, it should be understood by those skilled in the art that equivalent changes in the form and detail may be therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An anchoring device for use in a rock crevice, the anchoring device movable from a non-activated position to an activated position within the rock crevice, the rock crevice being defined by a first rock wall and an opposing second rock wall, the anchoring device comprising:

a first axle member;

a first cam rotatable about the first axle member, the first cam having a first side surface, a first bottom surface, and a first contact surface, the first contact surface contactable with the first rock wall;

a second axle member spaced in a parallel configuration from the first axle member; and a second cam rotatable about the second axle member, the second cam having a second side surface, a second bottom surface, and a second contact surface, the second contact surface contactable with the second rock wall; and spring means associated with the first cam and the second cam for biasing the first cam and the second cam into the non-activated position with the first cam and the second cam being adjacent each other wherein the spring means is a first torsion spring about the first axle member and secured to the first cam and a second torsion spring about the second axle member and secured to the second cam;

wherein in a non-activated position, the first axle member is closer to the first rock wall than the second axle member and the second axle member is closer to the second rock wall than the first axle member.

2. The anchoring device of claim 1, and further comprising:

a trigger mechanism for moving the first contact surface of the first cam and the second contact surface of the second cam in a general direction away from each other.

3. The anchoring device of claim 2, and further comprising:

a first wire connected between the trigger mechanism and the first cam; and a second wire connected between the trigger mechanism and the second cam.

4. The anchoring device of claim 1, and further comprising:

a center spacer positioned between the first axle member and the second axle member, the center spacer having a cable-receiving aperture.

5. The anchoring device of claim 4, and further comprising:

a cable secured within the cable-receiving aperture of the center spacer.

6. The anchoring device of claim 5 and further comprising:

a sheath about the cable.

7. An anchoring device for use in a rock crevice, the anchoring device movable from a non-activated position to an activated position within the rock crevice, the rock crevice being defined by a first rock wall and an opposing second rock wall, the anchoring device comprising:

a first axle member;

a first cam rotatable about the first axle member, the first cam having a first side surface, a first bottom surface, and a first contact surface, the first contact surface contactable with the first rock wall;

a second axle member soaced in a parallel configuration from the first axle member; and a second cam rotatable about the second axle member, the second cam having a second side surface, a second bottom surface, and a second contact surface, the second contact surface contactable with the second rock wall;

a third cam rotatable about the first axle member, the third cam having a third side surface, a third bottom surface, and a third contact surface, the third contact surface contactable with the first rock wall; and a fourth cam rotatable about the second axle member, the fourth cam having a fourth side surface, a fourth bottom surface, and a fourth contact surface, the fourth contact surface contactable with the second rock wall;

wherein in a non-activated position, the first axle member is closer to the first rock wall than the second axle member and the second axle member is closer to the second rock wall than the first axle member.

8. A method for securing a climber to a rock face, the method comprising:

positioning a first axle member adjacent a first rock wall;

positioning a first cam in a first longitudinal rotatable position about the first axle member, the first cam having a first side surface, a first bottom surface, and a first contact surface, the first contact surface contactable with the first rock wall;

positioning a second axle member in a spaced parallel configuration from the first axle member and adjacent a second rock wall;

positioning a second cam in a second longitudinal rotatable about the second axle member, the second cam having a second side surface, a second bottom surface, and a second contact surface, the second contact surface contactable with the second rock wall;

positioning a third cam in a third longitudinal rotatable position about the first axle member, the third cam having a third side surface, a third bottom surface, and a third contact surface, the third contact surface contactable with the first rock wall; and positioning a fourth cam in a fourth longitudinal rotatable position about the second axle member, the fourth cam having a fourth side surface, a fourth bottom surface, and a fourth contact surface, the fourth contact surface contactable with the second rock wall;

wherein in a non-activated position, the first axle member is closer to the first rock wall than the second axle member and the second axle member is closer to the second rock wall than the first axle member and the first bottom surface of the first cam is free from overlap with the second bottom surface of the second cam.

* * * * *